US009335720B1

(12) United States Patent
Omura et al.

(10) Patent No.: US 9,335,720 B1
(45) Date of Patent: May 10, 2016

(54) IMAGE FORMING APPARATUS

(71) Applicant: KYOCERA Document Solutions Inc., Osaka (JP)

(72) Inventors: Hiroyoshi Omura, Osaka (JP); Masayuki Yamada, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/936,108

(22) Filed: Nov. 9, 2015

(30) Foreign Application Priority Data

Nov. 28, 2014 (JP) ..... 2014-241157

(51) Int. Cl.
*G03G 21/00* (2006.01)
*G03G 21/16* (2006.01)

(52) U.S. Cl.
CPC ..... *G03G 21/1647* (2013.01); *G03G 21/168* (2013.01)

(58) Field of Classification Search
CPC ..... G03G 21/1647; G03G 21/1676; G03G 21/1652; G03G 21/1853; G03G 2221/1657; G03G 2221/1684; G03G 15/0865; G03G 15/0886
USPC ..... 399/121
See application file for complete search history.

(56) References Cited

U.S. PATENT DOCUMENTS 5,335,052 A * 8/1994 Sato ..... G03G 15/1655 399/312
2006/0193656 A1* 8/2006 Kumazawa ..... G03G 21/1647 399/121
2006/0228124 A1* 10/2006 Igarashi ..... G03G 15/0121 399/49

FOREIGN PATENT DOCUMENTS

JP 2000-321881 A 11/2000

* cited by examiner

*Primary Examiner* — Walter L Lindsay, Jr.
*Assistant Examiner* — Jessica L Eley
(74) *Attorney, Agent, or Firm* — Studebaker & Brackett PC

(57) ABSTRACT

An image forming apparatus includes a rail member and an intermediate transferring device. The rail member mounted to a frame. The intermediate transferring device attachably/detachably mounted to the rail member. The intermediate transferring device includes a toner carrier, a cleaning member, a first transmission mechanism and a second transmission mechanism. The toner carrier is driven to be rotated by a driving source, and configured to carry a toner image. The cleaning member is driven to be rotated by the driving source, and configured to remove a toner which remains on the toner image carrier. The first transmission mechanism configured to transmit a driving force of the driving source to the toner image carrier. The second transmission mechanism configured to transmit the driving force of the driving source to the cleaning member. The first transmission mechanism and the second transmission mechanism are arranged between the frame and the rail member.

6 Claims, 9 Drawing Sheets

IMAGE FORMING APPARATUS

INCORPORATION BY REFERENCE

This application is based on and claims the benefit of priority from Japanese Patent application No. 2014-241157 filed on Nov. 28, 2014, the entire contents of which are incorporated herein by reference.

BACKGROUND

The present disclosure relates to an image forming apparatus preferably applied in a copying machine, a printer or the like.

An electrophotographic image forming apparatus using an intermediate transfer method in order to form a color image is widely known.

For example, an image forming apparatus includes: an intermediate transferring belt (toner image carrier) which carries a four-color toner image on four photosensitive members; a transferring unit which transfers the toner image on the intermediate transferring belt to a sheet; and a cleaning device which removes the residual toner that could not be transferred to the sheet, from a surface of the intermediate transferring belt. The intermediate transferring belt is overhung between a driving roller and a driven roller. A cleaning roller of the cleaning device is disposed to be opposed to the driven roller. A timing belt is overhung between the cleaning roller and the driving roller.

The above mentioned technique has transferred a driving force of the intermediate transferring belt to the cleaning roller by the timing belt so far. In general, the timing belt is provided to be exposed to the outside of a frame which supports the intermediate transferring belt so as not to interfere with the intermediate transferring belt. In an image forming apparatus downsized, there has been often a case in which a plurality of electrical components such as a harness and a board are disposed in the vicinity of the timing belt. In this case, there has been an apprehension that the traveling timing belt comes into contact with the electrical components, and an appropriate transmission of the driving force cannot be carried out. Also, there has been an apprehension that dust exerted by abrasion of the belt adheres to the electrical components and the electrical components causes an operation failure.

SUMMARY

In accordance with an embodiment of the present disclosure, an image forming apparatus includes a rail member and an intermediate transferring device. The rail member mounted to a frame. The intermediate transferring device attachably/detachably mounted to the rail member. The intermediate transferring device includes a toner carrier, a cleaning member, a first transmission mechanism and a second transmission mechanism. The toner carrier is driven to be rotated by a driving source, and configured to carry a toner image. The cleaning member is driven to be rotated by the driving source, and configured to remove a toner which remains on the toner image carrier. The first transmission mechanism configured to transmit a driving force of the driving source to the toner image carrier. The second transmission mechanism configured to transmit the driving force of the driving source to the cleaning member. The first transmission mechanism and the second transmission mechanism are arranged between the frame and the rail member.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, a preferable embodiment of the present disclosure will be described with reference to the appended drawings. It is noted that directions are indicated appropriately in each drawing in the following description.

Figure 1:
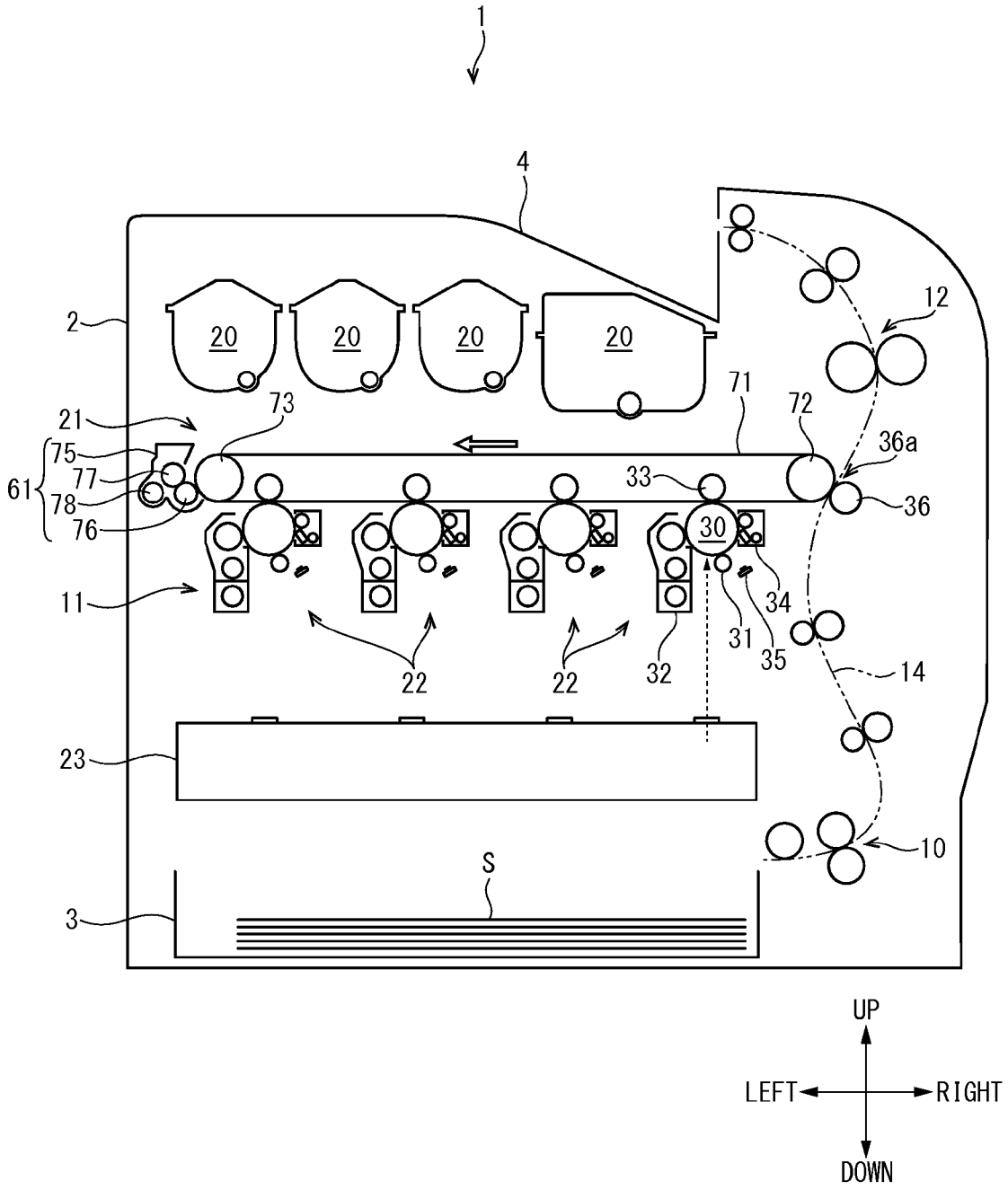
FIG. 1 is a sectional view schematically showing an inner structure of a color printer according to one embodiment of the present disclosure.

An entire configuration of a color printer 1, i.e., an image forming apparatus, will be described with reference to FIG. 1. FIG. 1 is a sectional view schematically showing an inner structure of the color printer 1.

The color printer 1 includes: an apparatus main body 2 formed in a substantial box shape; a sheet feeding cartridge 3 provided at a lower part of the apparatus main body 2; and a sheet feeding tray 4 provided at an upper part of the apparatus main body 2.

Also, the color printer 1 includes: a sheet feeder 10; an image forming unit 11; and a fixing device 12. The sheet feeder 10 is provided on an upstream side of a conveying path 14 in order to feed a sheet S in the sheet feeding cartridge 3 to the conveying path 14. The image forming unit 11 is provided inside of the apparatus main body 2. The fixing device 12 is provided on a downstream side of the conveying path 14. Incidentally, the sheet S to be housed in the sheet feeding cartridge 3 may be a plastic film or an OHP sheet or the like without being limitative to a piece of paper.

The image forming unit 11 is configured to include: four toner containers 20; an intermediate unit 21; four drum units 22; and an optical scanning device 23. The four toner containers 20 are provided in parallel to each other in a right-left direction on a lower side of the sheet feeding tray 4. The intermediate unit 21 is arranged on a lower side of each of the toner containers 20. The four drum units 22 are provided in parallel to each other in the right-left direction on a lower side of the intermediate unit 21. The optical scanning device 23 is arranged on a lower side of each of the drum units 22.

The four toner containers 20 house toners (developing agents) of four colors (yellow, magenta, cyan, black). Incidentally, the toner may be a single-component developing agent made of a magnetic toner or may be a double-component developing agent including a toner and a carrier. Although a detailed description will be given later, the intermediate unit 21 is configured to include an intermediate transferring belt 71 to be driven to travel in the direction indicated by the outline arrow of FIG. 1.

The four drum units 22 are provided corresponding to the toners of the respective colors. Each of the drum units 22 is configured to include: a photosensitive drum 30; a charging device 31; a development device 32; a primary transferring roller 33; a drum cleaning device 34; and a static eliminator 35. Incidentally, the four drum units 22 each have a similar configuration; and therefore, one of the drum units 22 will be described hereinafter.

The photosensitive drum 30 is formed in a cylindrical shape which is elongated in a front-rear direction, and is supported by the apparatus main body 2 so as to rotate around a coaxial center. The photosensitive drum 30 comes into contact with a lower surface of the intermediate transferring belt 71. The charging device 31, the development device 32, the primary transferring roller 33, the drum cleaning device 34, and the static eliminator 35 are disposed in sequential order of the transferring steps around the photosensitive drum 30. The primary transferring roller 33 is disposed to be opposed to the photosensitive drum 30 from the top side while the intermediate transferring belt 71 is sandwiched therebetween. On the right side of the intermediate transferring belt 71, a secondary transferring roller 36 is disposed, and a secondary transferring nip 36*a* is formed.

Here, an operation of the color printer 1 will be described. A control device (not shown) of the color printer 1 executes image forming processing as shown below, on the basis of input image data.

Each of the charging devices 31 charges a surface of the photosensitive drum 30. The optical scanning device 23 carries out exposure (refer to the dashed-like arrow of FIG. 1) corresponding to image data for each photosensitive drum 30. Each of the development devices 32 develops, to a toner image, an electrostatic latent image formed on the surface of each photosensitive drum 30. The four toner images that are carried to the respective photosensitive drums 30 are primarily transferred to the traveling intermediate transferring belt 71 in sequential order by the primary transferring roller 33 to which a primary transferring bias has been applied. Thereby, a full-color toner image is formed on a surface of the intermediate transferring belt 71.

On the other hand, the sheet S having been fed from the sheet feeding cartridge 3 is conveyed through the conveying path 14, and passes through the secondary transferring nip 36*a*. The full-color toner image is secondarily transferred to the sheet S by the secondary transferring roller 35 to which a secondary transferring bias has been applied. The fixing device 12 fixes the full-color toner image to the sheet S. The sheet S after fixed is ejected to the sheet ejecting tray 4. The drum cleaning device 34 removes the remaining toner on the surface of the photosensitive drum 30 after transferred. The static eliminator 35 eliminates an electric charge of the photosensitive drum 30 by irradiation with static eliminating light.

Figure 2:
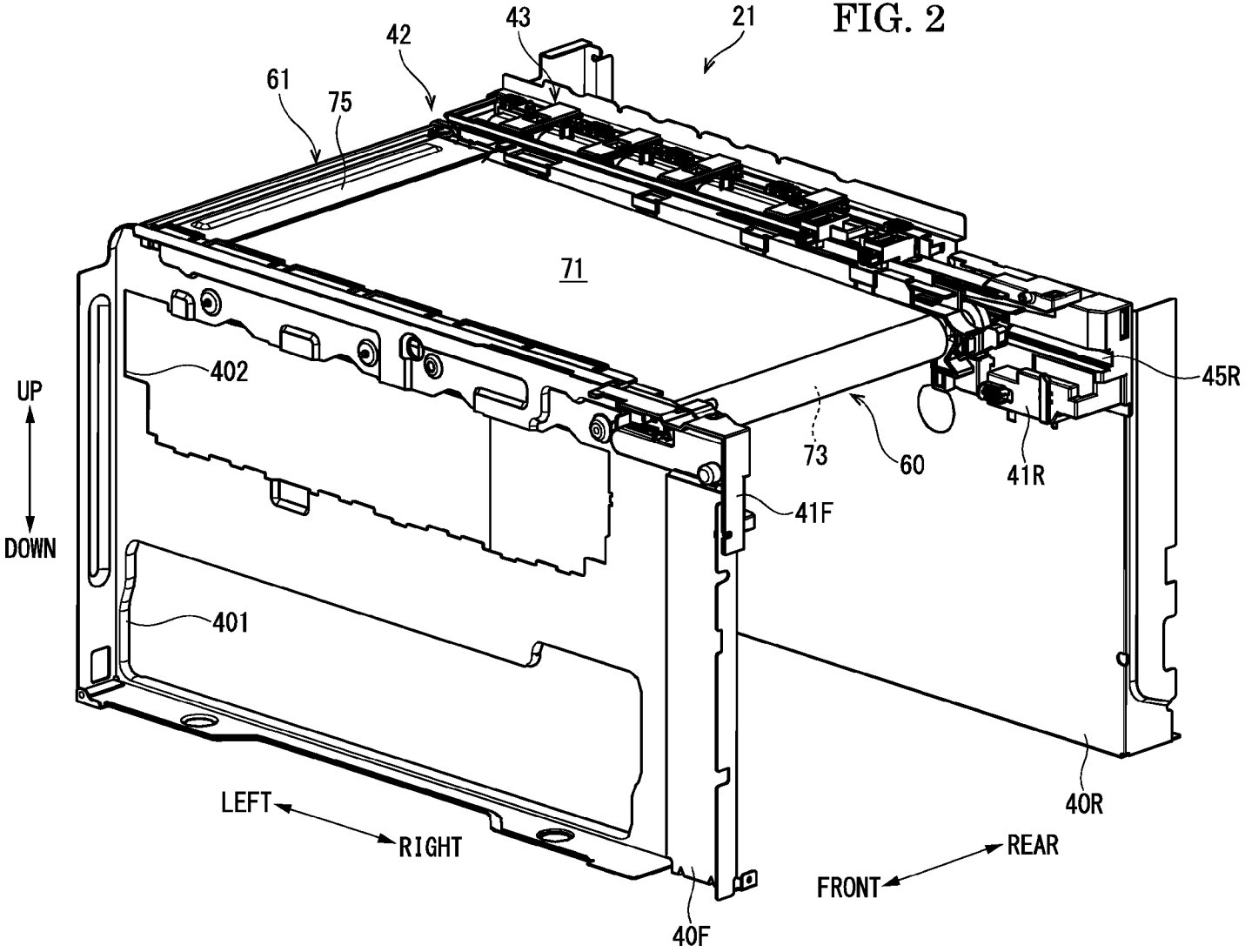
FIG. 2 is a perspective view showing an intermediate unit of the color printer of one embodiment of the present disclosure.
Figure 3:
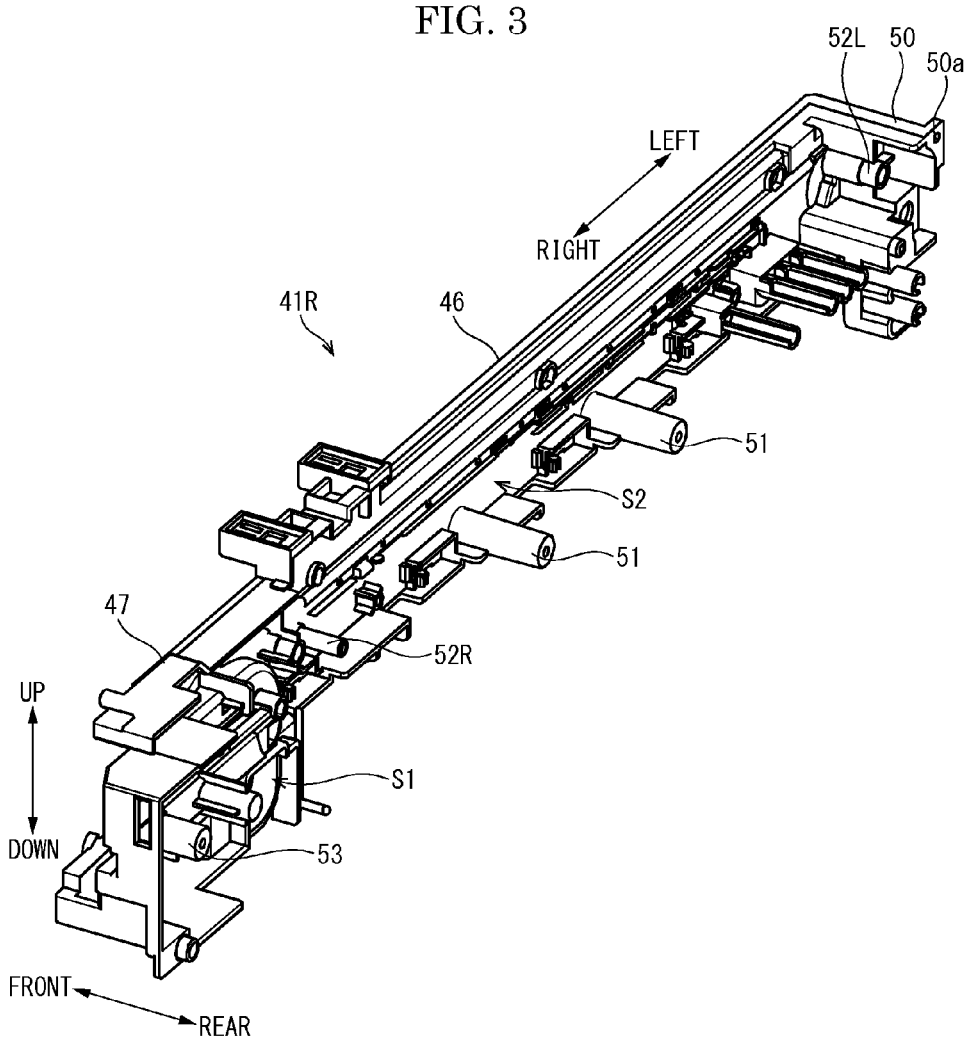
FIG. 3 is a perspective view showing a rail member of the color printer of one embodiment of the present disclosure.
Figure 4:
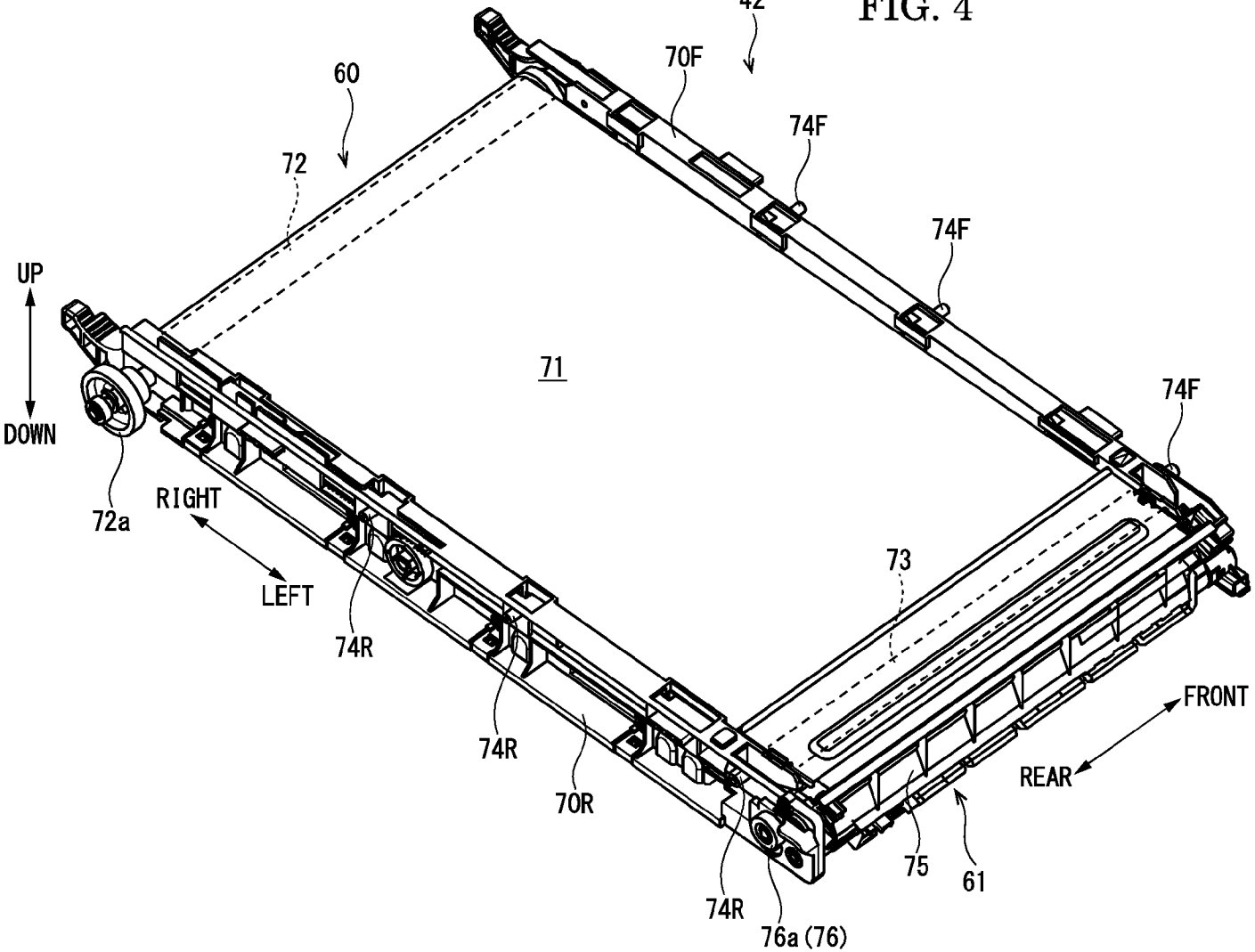
FIG. 4 is a perspective view showing a belt traveling device and a belt cleaning device of the color printer of one embodiment of the present disclosure.
Figure 5:
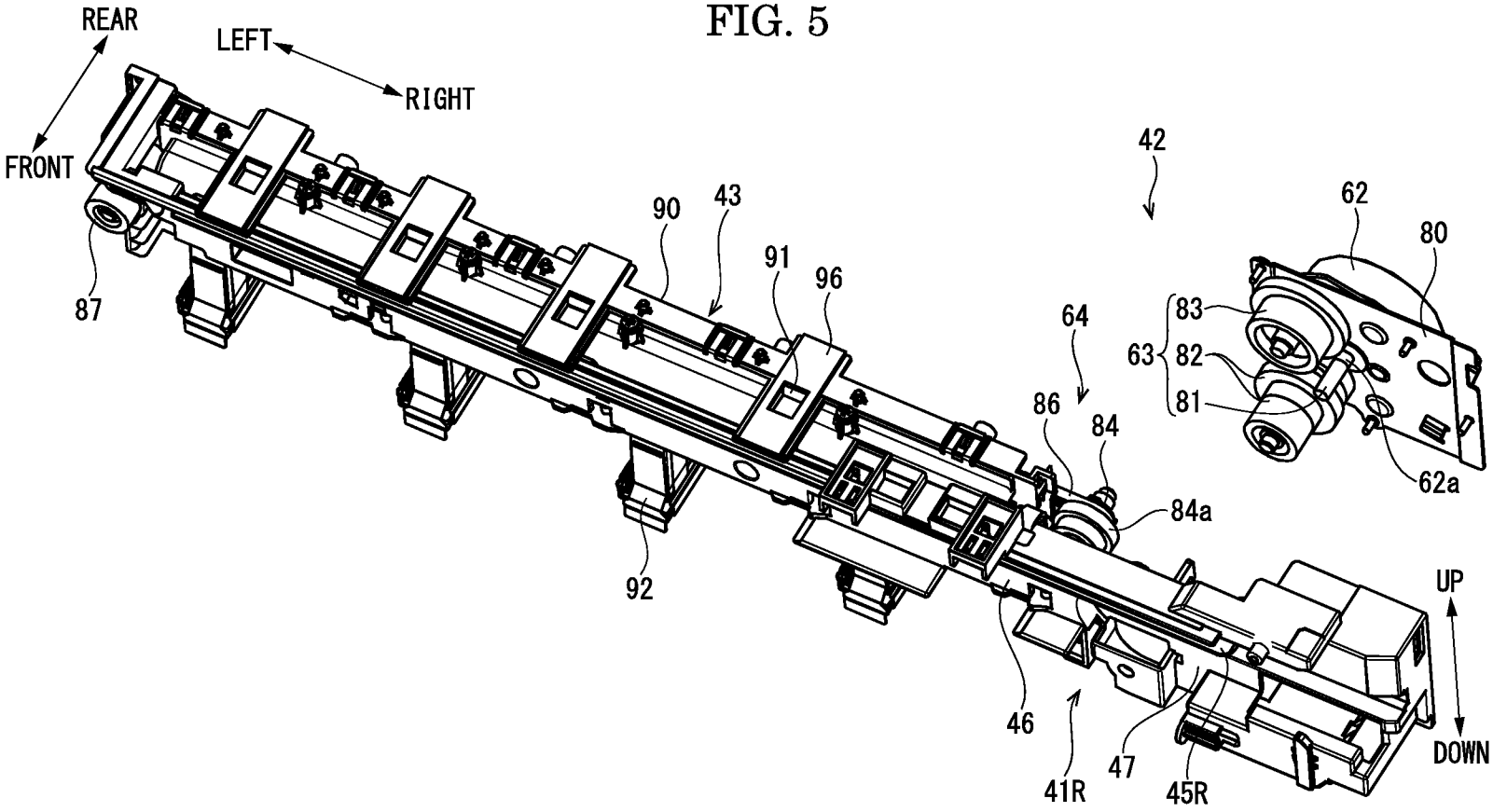
FIG. 5 is a perspective view showing a driving motor and a first transmission mechanism or the like of the color printer of one embodiment of the present disclosure.
Figure 6:
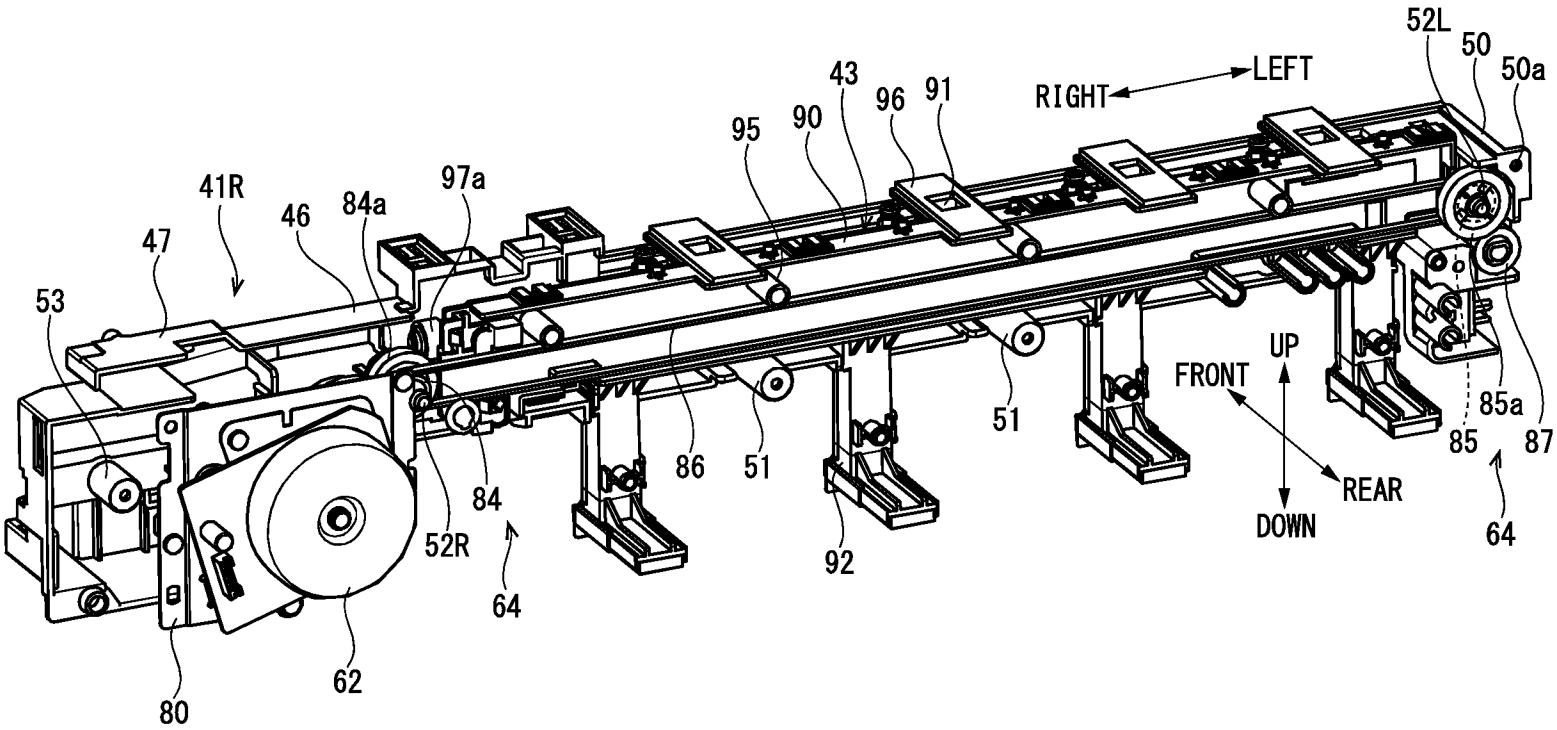
FIG. 6 is a perspective view showing a united rail member of the color printer of one embodiment of the present disclosure.
Figure 7:
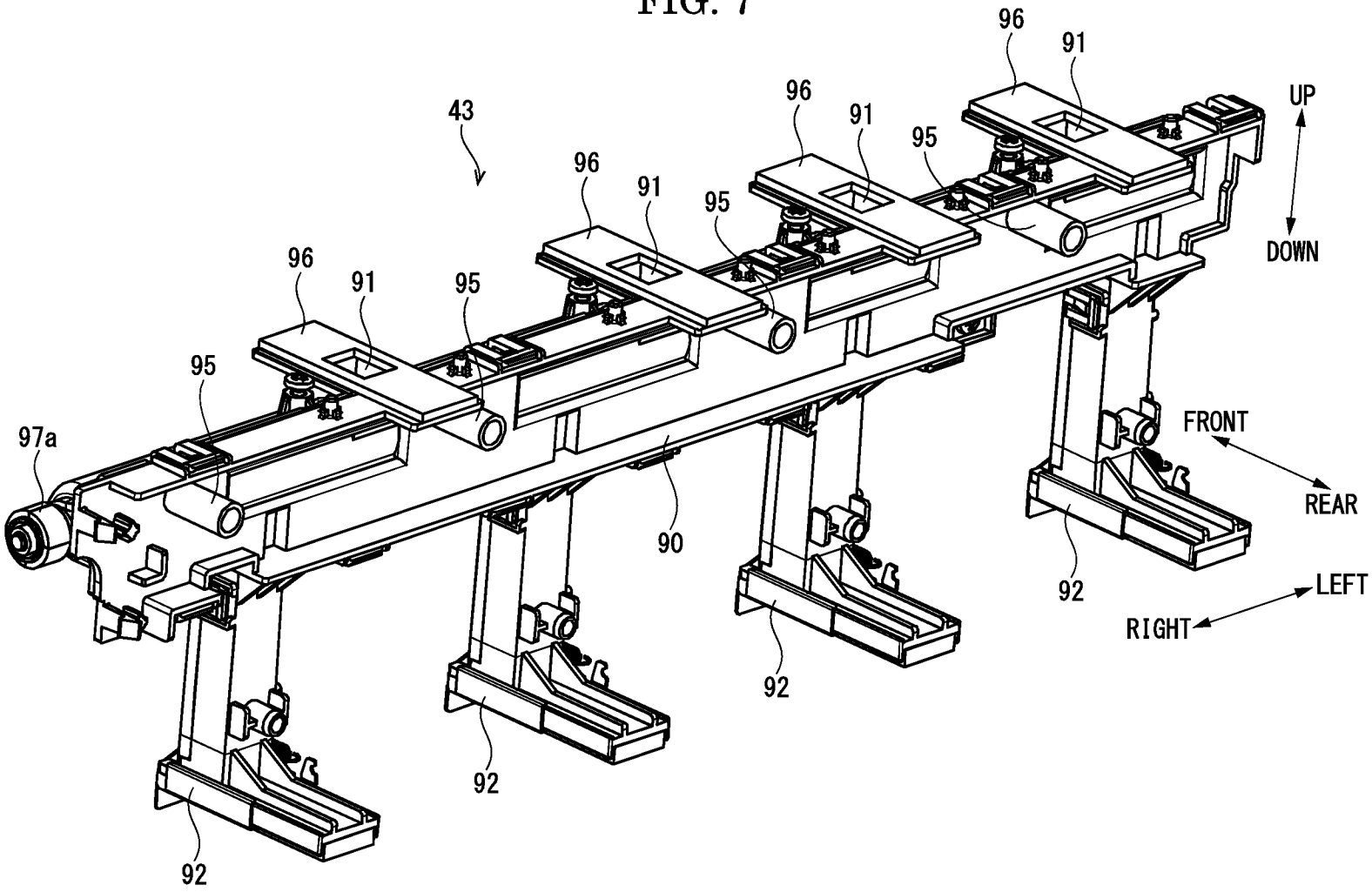
FIG. 7 is a perspective view showing a toner conveying device of the color printer of one embodiment of the present disclosure.
Figure 8:
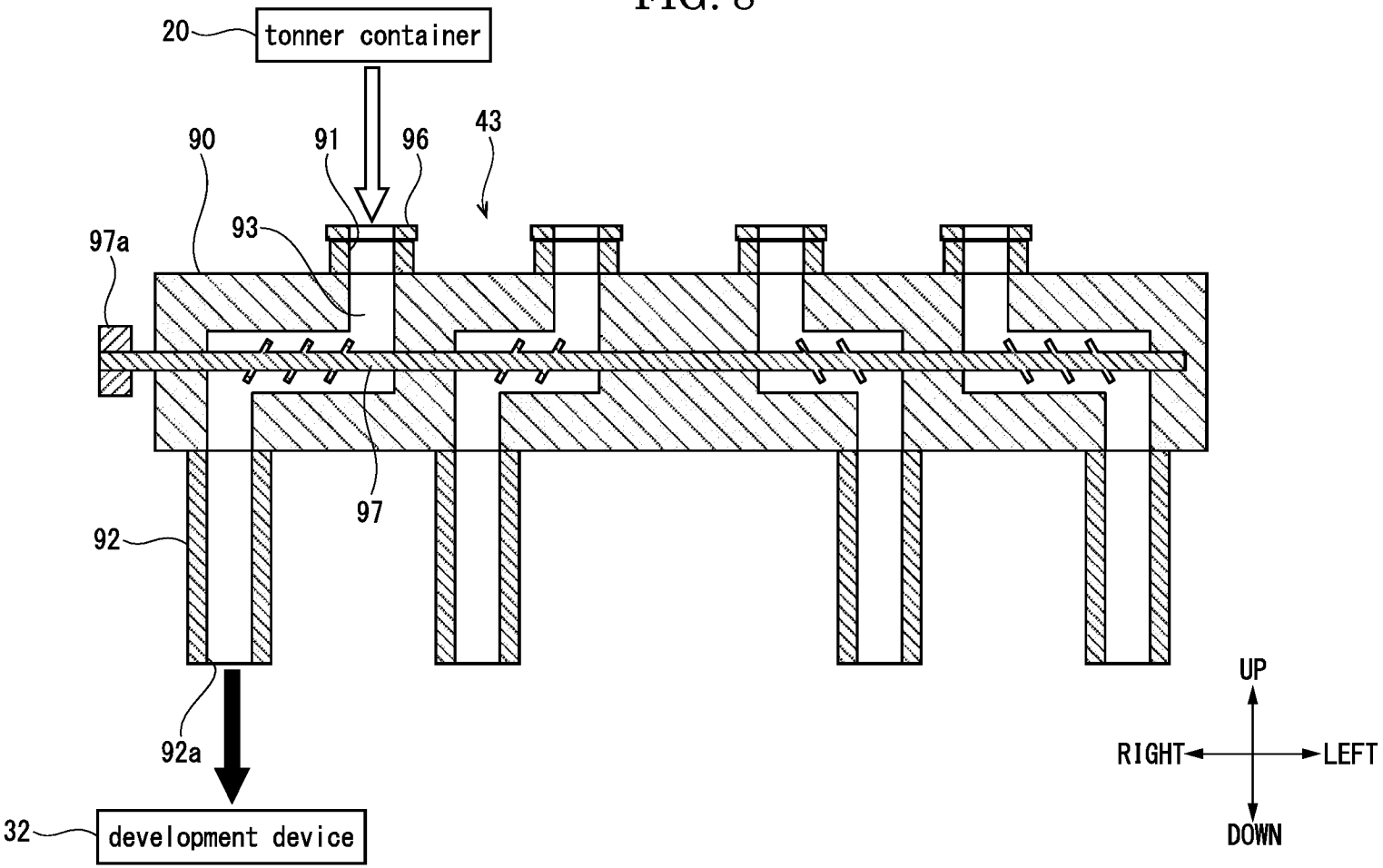
FIG. 8 is a sectional view schematically showing the toner conveying device of the color printer of one embodiment of the present disclosure.
Figure 9:
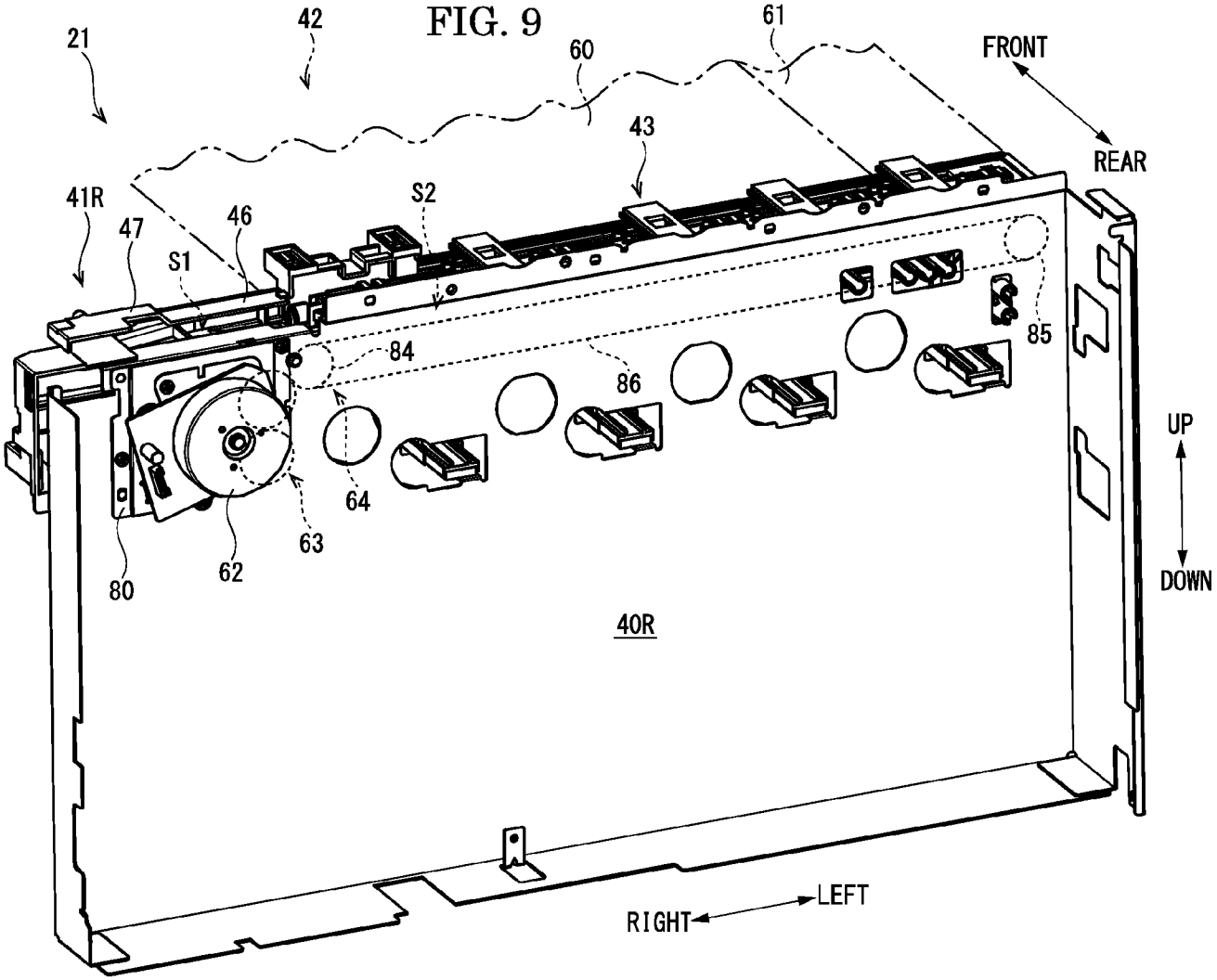
FIG. 9 is a perspective view showing a frame and the united rail member of the color printer of one embodiment of the present disclosure.

Next, The intermediate unit 21 will be described in detail below with reference to FIGS. 1 through 9. FIG. 2 is a perspective view showing the intermediate unit 21. FIG. 3 is a perspective view showing a rail member 41R. FIG. 4 is a perspective view showing a belt traveling device 60 and a belt cleaning device 61. FIG. 5 is a perspective view showing a driving motor 62 and a first transmission mechanism 63 or the like. FIG. 6 is a perspective view showing a united rail member 41R. FIG. 7 is a perspective view showing a toner conveying device 43. FIG. 8 is a sectional view schematically showing the toner conveying device 43. FIG. 9 is a perspective view showing a frame 40R and the united rail member 41R.

As shown in FIG. 2, the intermediate unit 21 is configured to include: a pair of front and rear frames 40F, 40R; a pair of front and rear rail members 41F, 41R; an intermediate transferring device 42; and a toner conveying device 43. The pair of front and rear frames 40F, 40R are disposed to be opposed to each other in the front-rear direction. The pair of front and rear rail members 41F, 41R are respectively mounted to the insides of the frames 40F, 40R. The intermediate transferring device 42 is attachably/detachably supported by the pair of front and rear frames 40F, 40R. The toner conveying device 43 is configured so as to convey the toner that is housed in the respective toner containers 20 toward the respective development devices 32.

The pair of front and rear frames 40F, 40R each are formed in a metal plate, and are formed in a substantially rectangular shape in a front view. The pair of front and rear frames 40F, 40R are spaced from each other, each of which is disposed in an erected posture on a bottom plate of the apparatus main body 2. Incidentally, in the front frame 49F, attachment/detachment opening 401 of the sheet feeding cartridge 3 and a mounting opening 402 or the like, of each of the drum units 22 or the like, are formed. Incidentally, although not shown, rear of the rear frame 40R, a plurality of electrical components, such as a board of the control device and a harness which connects the respective devices to each other, are arranged.

The pair of front and rear rail members 41F, 41R are respectively integrally formed to be elongated in the right-left direction, and are formed of well slidable plastics (for example, polyacetal (polyoxymethylene)). The pair of front and rear rail members 41F, 41R are fixed to the inside tops of the respective frames 40F, 40R. On side faces opposing to each other, of the pair of front and rear rail members 41F, 41R, guiding gaps 45R extending in the right-left direction are provided in a depressed manner. Incidentally, a guiding gap of the rail member 41F is not shown.

Although a detailed description will be given later, the intermediate transferring device 42 is disposed between the pair of front and rear rail members 41F and 41R so as to slide in the right-left direction along the pair of guiding gaps 45R. This mechanism for driving the intermediate transferring device 42 is retained by the rear rail member 41R. Hereinafter, the rear rail member 41R will be described.

As shown in FIG. 3, the rear rail member 41R has: a belt housing 46; and a gear housing 47.

The belt housing 46 is formed to be elongated in the right-left direction. At the left end of the belt housing 46, an abutment piece 50 is extended toward the rear side. A tip end (rear end) of the abutment piece 50 is formed in a flange shape. In the tip end of the abutment piece 50, a through hole 50*a* penetrating in the front-rear direction is formed. At a transverse intermediate part of the belt housing 46, a pair of left and right screw hole bosses 51 are extended toward a rear side. The pair of left and right screw hole bosses 51 are spaced from each other, and are protruded at a lower part of a rear face of the belt housing 46.

At both of the left and right ends of the belt housing 46, a pair of left and right pulley supporting shafts 52L, 52R are extended toward a rear side. The pair of left and right pulley supporting shafts 52L, 52R are protruded at an intermediate part in a vertical direction on the rear face of the belt housing 46.

The gear housing 47 is continuously provided at a right end of the belt housing 46. The gear housing 47 extends more downward than the belt housing 46, and is formed in a substantially rectangular box shape which opens a rear side. On a right rear face (bottom face) of the gear housing 47, a screw hole boss 53 is protruded.

The abutment piece 50 and the respective screw hole bosses 51, 52 have a function of spacing the frame 40R and the rail member 41R from each other by abutting a tip end face thereof against the frame 40R. Therefore, in a state in which the rail member 41R is fixed to the rear frame 40R (refer to FIG. 2), a gear housing space S1 is formed inside of the gear housing 47, and a belt housing space S2 is formed inside of the belt housing 46. The gear housing space S1 communicates with the belt housing space S2. Incidentally, the abutment piece 50 is fixed to the frame 40R by means of the bolt/nut inserted through the through hole 50*a*. Also, a screw having penetrated from the rear side of the frame 40R is threadly engaged with tip end face of each of the screw hole bosses 51, 53.

As shown in FIG. 4 and FIG. 5, the intermediate transferring device 42 is configured to include: a belt traveling device 60; a belt cleaning device 61; a driving motor 62; a first transmission mechanism 63; and a second transmission mechanism 64.

As shown in FIG. 4, the belt traveling device 60 is configured to include: a pair of front and rear belt frames 70F, 70R; an intermediate transferring belt 71; a driving roller 72; and a driven roller 73.

The pair of front and rear belt frames 70F, 70R each are formed of plastics, for example, in an elongated substantially rectangular shape in the right-left direction in a front view. The pair of front and rear belt frames 70F, 70R are disposed to be spaced from each other. The pair of front and rear belt frames 70F, 70R respectively have a plurality of (for example, three) guiding bosses 74F, 74R which are protruded on both front and rear exterior faces. Three front and rear guiding bosses 74F, 74R of a respective one of two groups are provided in parallel to each other all over the left side from an intermediate part in the right-left direction at the upper part of the exterior face of each of the belt frames 70F, 70R. Incidentally, the respective guiding bosses 74F, 74R slidably engage with the respective guiding gaps 45R of the rail members 41F, 41R.

The intermediate transferring belt 71 as a toner image carrier is formed of plastics in an endless manner, for example. As has been described so far, the intermediate transferring belt 71 is overhung between the driving roller 72 and the driven roller 73 (refer to FIG. 1). Incidentally, although not shown, in addition to the rollers 72, 73, a plurality of tension rollers are provided, and a predetermined tension force is applied to the intermediate transferring belt 71.

The driving roller 72 and the driven roller 73 are disposed between the pair of front and rear belt frames 70F and 70R. The driving roller 72 is pivoted at the right end of each of the belt frames 70F, 70R. The driven roller 73 is pivoted at the left end of each of the belt frames 70F, 70R. The driving roller 72 (a shaft of the driving roller 72) is extended rearward through the rear belt frame 70R. At a rear end of the driving roller 72 (the shaft), a driving gear 72*a* is axially attached.

As shown in FIG. 1, the belt cleaning device 61 is configured to include: a cleaning case 75; a cleaning roller 76; a collecting roller 77: and a collecting screw 78.

The cleaning case 75 is formed in a substantial box shape which is elongated in the front-rear direction and which opens a right side face (refer to FIG. 4). Both ends in the front-rear direction of the cleaning case 75 are respectively fixed to left ends of the pair of front and rear belt frames 70F, 70R (refer to FIG. 4). The cleaning case 75 is arranged in a posture in which an opening is oriented toward the intermediate transferring belt 71.

The cleaning roller 76, as a cleaning member, has a plurality of removing brushes (not shown) which are embedded on a circumferential face of a cylindrical axis which is elongated in the front-rear direction. The cleaning roller 76 is exposed from an opening of the cleaning case 75, and is arranged to be opposed to a lower left side of the driven roller 73 while the intermediate transferring belt 71 is sandwiched therebetween. The cleaning roller 76 is rotatably supported around a shaft inside of the cleaning case 75. The cleaning roller 76 rotates while coming into contact with the intermediate transferring belt 71, and eliminates the remaining toner (residual toner) on the surface of the intermediate transferring belt 71. Incidentally, a power unit (not shown) is connected to the cleaning roller 76, and a bias of which polarity is reversed from that of the remaining toner is applied.

As shown in FIG. 4, The cleaning roller 76 (a cylindrical shaft of the cleaning roller 76) is extended rearward through the cleaning case 75 and the belt frame 70R. At a rear end of the cleaning roller 76 (the cylindrical shaft), a driving gear 76*a* is axially attached.

As shown in FIG. 1, the collecting roller 77 is formed in a cylindrical shaft which is elongated in the front-rear direction, and is arranged at an upper left side of the cleaning roller 76. The collecting roller 77 is rotatably supported around the shaft inside of the cleaning case 75. The collecting roller 77 rotates while coming into contact with the cleaning roller 76, and collects the remaining toner on the cleaning roller 76. Incidentally, a tip end of a blade (not shown) which is mounted to the cleaning case 75 abuts against the collecting roller 77.

The collecting screw 78 is formed in a spiral shape which is elongated in the front-rear direction, and is disposed rearward of the cleaning roller 76. The collecting screw 78 is rotatably supported around the shaft inside of the cleaning case 75. The collecting screw 78 conveys the remaining toner that has been collected for a discarding bottle (not shown).

Incidentally, although not shown, the collecting roller 77 and the collecting screw 78 are connected to each other via a gear train so as to rotate integrally with the cleaning roller 76. Also, although not shown, the belt cleaning device 61 has a bar brush which charges the remaining toner on the intermediate transferring belt 71.

As shown in FIG. 5 and FIG. 6, the driving motor 62 is fixed to a rear face of a mounting plate 80 by means of screw (not shown). The driving motor 62 is mounted to an upper right side of the rear frame 40R via the mounting plate 80 (refer to FIG. 9). A rotating shaft 62*a* of the driving motor 62 is extended forward through the frame 40R (the mounting plate 80). Incidentally, the driving motor 62 is appropriately controlled by the control device.

The first transmission mechanism 63 is configured to include: a pinion gear 81; a driving input gear 82; and a transmission input gear 83.

The pinion gear 81 is pivoted at a tip end of the rotating shaft 62*a* of the driving motor 62. The driving input gear 82 is rotatably supported by the mounting plate 80 at a lower left side of the pinion gear 81. The driving input gear 82 meshes with the lower left side of the pinion gear 81. The transmission input gear 83 is rotatably supported by the mounting plate 80 upward of the driving input gear 82. The transmission input gear 83 meshes with an upper part of the driving input gear 82.

As shown in FIG. 6, the second transmission mechanism 64 is configured to include: a driving pulley 84; a driven puller 85; a timing belt 86; and a transmission output gear 87.

The driving pulley 84 is rotatably supported by a right pulley supporting shaft 52R of the rail member 41R (the belt housing 46). At a front side of the driving pulley 84, a transmission driving gear 84*a* is fixed to be coaxial to the driving pulley 84. The driven pulley 85 is rotatably supported by a left pulley supporting shaft 52L of the rail member 41R. At a rear side of the driven puller 85, a transmission driven gear 85*a* is fixed to be coaxial to the driven pulley 85. The timing belt 86 is formed of plastics in an endless manner, for example. The timing belt 86 is overhung between the driving pulley 84 and the driven pulley 85.

The transmission output gear 87 is rotatably supported by the belt housing 46 on the lower side of the driven pulley 85. The transmission output gear 87 meshes with a lower side of the transmission driven gear 85*a*.

As shown in FIG. 7 and FIG. 8, the toner conveying device 43 is configured to include: a conveying case 90; four conveyance and replenishment ports 91; four conveying and discharging pipes 92; and four intermediate conveying paths 93.

The conveying case 90 is formed in a substantially rectangular parallelepiped shape which is elongated in the right-left direction and which is small in thickness in the front-rear direction. At an upper part of a rear face of the conveying case 90, four abutment bosses 95 are protruded. The four abutment bosses 95 are provided in parallel to each other in the right-left direction on the rear face of the conveying case 90.

The four conveyance and replenishment ports 91 are provided in parallel to each other in the right-left direction on a top face of the conveying case 90 so as to correspond to the four toner containers 20. Each of the conveyance and replenishment ports 91 is connected to a discharging port (not shown) of each of the toner containers 20. Incidentally, four shutters 96 are arranged in the conveying case 90.
The respective shutters 96 open the conveyance and replenishment ports 91 when the toner containers 20 mounted, and close the conveyance and replenishment port 91 when the toner containers 20 demounted.

The four conveying and discharging pipes 91 are provided in parallel to each other in the right-left direction on the lower face of the conveying case 90 so as to correspond to supplying ports (not shown) of the four development devices 32. Each of the conveying and discharging pipes 92 is extended downward from the lower face of the conveying case 90. On a lower end face of each of the conveying and discharging pipe 92, a conveying and discharging port 92*a* connected to the supplying port of the development device 32 opens (refer to FIG. 8).

As shown in FIG. 8, the four intermediate conveying paths 93 are respectively formed inside of the conveying case 90 and the conveying and discharging pipe 92 so as to cause the conveyance and replenishment port 91 and the conveying and discharging port 92*a* to communicate with each other. Each of the intermediate conveying paths 93 is formed in a substantial crank shape in a rear view (or in a front view). In the conveying case 90, a conveying screw 97 is pivoted so as to penetrate horizontal parts of all the intermediate conveying paths 93. The conveying screw 97 (a shaft of the conveying screw 97) is extended rightward through a right side wall of the conveying case 90. At a right end of the conveying screw 97 having penetrated the conveying case 90, a conveyance input gear 97*a* is axially attached.

As indicated by the outline arrow of FIG. 8, toner is discharged from the discharging port of each of the toner containers 20, and is introduced from the conveyance and replenishment port 91 into the intermediate conveying path 93. The toner in the intermediate conveying path 93 is conveyed toward the respective conveying and discharging ports 92*a* by means of the rotating conveying screw 97. Afterwards, as indicated by the filled arrow of FIG. 8, the toner is discharged from the conveying and discharging port 92, and is replenished into the development device 32.

Next, the steps of assembling the intermediate unit 21 will be described. First, a worker mounts the toner conveying device 43 to a rear side of the rail member 41R (refer to FIG. 6). Specifically, the conveying case 90 of the toner conveying device 43 is fixed to a rear face of the belt housing 46 by means of a plurality of screws (not shown). In this state, a tip end face (rear end face) of each of the abutment bosses 95 is formed on a planar face which is the same as the tip end faces of the abutment piece 50 and each of the screw hole bosses 51, 53 (refer to FIG. 8).

Next, as shown in FIG. 5, the worker pivots the respective gears 81 to 83 to the mounting plate 80 of the driving motor 62, and configures the first transmission mechanism 63. Thereby, the driving motor 62 and the first transmission mechanism 63 are integrated (united) with each other.

Also, as shown in FIG. 6, the worker mounts the second transmission mechanism 64 to the rear side of the rail member 41R. Specifically, the worker pivots the pair of left and right pulleys 84, 85 to the pair of left and right pulley supporting shafts 52L, 52R, and overhangs the timing belt 86 between the pair of left and right pulleys 84 and 85. Thereby, the toner conveying device 43 and the second transmission mechanism 64 are coupled to the rail member 41R, and are integrated (united) with each other. Incidentally, in this state, the transmission driving gear 84*a* that is provided at the driving pulley 84 of the second transmission mechanism 64 is connected to the conveyance input gear 97*a* of the conveying screw 97 via another gar which is not shown.

Next, the worker mounts the united rail member 41R to an interior face (front face) of the frame 40R (refer to FIG. 2). The rail member 41R is fixed to an upper part of the frame 40R by means of a plurality of screws (not shown). At this juncture, the tip end faces of the abutment piece 50, the respective screw hole bosses 51, 53 and the respective abutment bosses 95 abut against the frame 40R. Thereby, between the frame 40R and the rail member 41R, the belt housing space S2 and the gear housing space S1 are formed.

As shown in FIG. 9, in a state in which the rail member 41R is fixed to the frame 40R, the respective pulleys 84, 85 and the timing belt 86 that constitute the second transmission mechanism 64 are disposed in the belt housing space S2 of the rail member 41R. That is, the second transmission mechanism 64 is disposed between the frame 40R and the rail member 41R. Similarly, the toner conveying device 43 is arranged between the frame 40R and the rail member 41R (precisely, between the rail member 41R and the second transmission mechanism 64).

Next, the worker mounts the united driving motor 62 from the rear face of the frame 40R. The mounting plate 80 of the driving motor 62 is fixed to a rightward upper part of the frame 40R by means of a plurality of screws (not shown). In this state, the respective gears 81 to 83 that constitute the first transmission mechanism 63 are disposed in the gear housing space S1 of the rail member 41R that is fixed to the frame 40R. That is, the first transmission mechanism 63 is arranged between the frame 40R and the rail member 41R.

Also, in this state, the transmission input gear 83 of the first transmission mechanism 63 meshes with the transmission driving gear 4*a* that is provided at the driving pulley 84 of the second transmission mechanism 64 (refer to FIG. 5). Thereby, the driving pulley 84 is driven to be rotated by the driving motor 62. In addition, the conveying screw 97 of the toner conveying device 43 is driven to be rotated by the driving motor 62.

Incidentally, the front rail member 41F is fixed to the interior face (rear face) of the frame 40F by means of a plurality of screws (not shown).

Next, as shown in FIG. 2, the worker mounts the belt traveling device 60 and the belt cleaning device 61 (hereinafter, referred to as "belt traveling device 60 or the like") between the pair of front and rear belt members 41F and 41R. Specifically, the worker advances the guiding bosses 74F, 74R of the pair of front and rear belt frames 70F, 70R from the right side with respect to the guiding gaps 45R of the pair of front and rear rail members 41F, 41R. Afterwards, the worker slides the belt traveling device 60 or the like from the right side to the left side along the respective guiding gaps 45R.

When the belt traveling device 60 or the like is slid up to the left end of each of the rail members 41F, 41R, the belt traveling device 60 or the like is supported by the respective frames 40F, 40R via the respective rail members 41F, 41R (assembling completes). In this state, the driving gear 72*a* of the driving roller 72 meshes with the driving input gear 82 of the first transmission mechanism 63 (refer to FIG. 4 and FIG. 5). Thereby, the driving roller 72 is driven to be rotated by the driving motor 62 via the first transmission mechanism 63. Also, the driving gear 76*a* of the cleaning roller 76 meshes with the transmission output gear 87 of the second transmission mechanism 64 (refer to FIG. 4 and FIG. 5). Thereby, the cleaning roller 76 is driven to be rotated by the driving motor 62 via the second transmission mechanism 64.

Subsequently, with reference to FIG. 5 and FIG. 6, functions of the intermediate transferring device 42 will be described. The driving motor 62 that is controlled to be driven by the control device rotates the driving roller 72 via the pinion gear 81 and the driving input gear 82. Thereby, the intermediate transferring belt 71 is driven (traveling is started) by the driving motor 62, and a full-color toner image can be carried. As described above, the first transmission mechanism 63 is capable of transmitting a driving force of the driving motor 62 to the intermediate transferring belt 71.

Also, the driving motor 62 rotates the transmission driving gear 84*a* of the second transmission mechanism 64 via the respective gears 81 to 83 of the first transmission mechanism 63. The driving pulley 84 that rotates integrally with the transmission driving gear 84*a* rotates the driven pulley 85 via the timing belt 86. The transmission driven gear 85*a* that rotates integrally with the driven pulley 85 rotates the cleaning roller 76 via the transmission output gear 87. That is, the driven pulley 85 is rotatably provided to move together with the cleaning roller 76. Thereby, the cleaning roller 76 is driven to be rotated by the driving motor 62, making it possible to remove the remaining toner on the intermediate transferring belt 71. As described above, the second transmission mechanism 64 is capable of transmitting a driving force of the driving motor 62 to the cleaning roller 76.

With the color printer 1 according to the embodiment described above, the first transmission mechanism 63 and the second transmission mechanism 64 are arranged between the frame 40R and the rail member 41R so as not to be exposed to the outside of the respective frames 40F, 40R. For example, even if electrical components such as a harness and a board are arranged outside (on the rear side) of the frame 40R, the respective transmission mechanisms 63, 64 do not come into contact with the electrical components. Thereby, the respective transmission mechanisms 63, 64 are capable of transmitting an appropriate driving force to the intermediate transferring belt 71 (driving roller 72) and the cleaning roller 76.

With the color printer 1 according to the embodiment, the timing belt 86 is arranged inside of the frame 40R, thus making it possible to prevent contact between the electrical components or the like outside of the frame 49R and the timing belt 86. Also, it is possible to restrain scattering of the dust caused by abrasion of the timing belt 86 or the grease of a movable part or the like. Thereby, adhering of the dust or the like to the electrical components is restrained and thus an operation failure of the electrical components can be prevented.

In addition, with the color printer 1 according to the embodiment, the toner conveying device 43 is arranged inside of the frame 40R and thus, for example, the toner having leaked out from the respective toner containers 20 or the respective development devices 32 converges inside of the frame 40R without scattering. Thereby, it is possible to restrain adhering of the toner that has leaked out therefrom to the electrical components or the like outside of the frame 40R.

Further, with the color printer 1 according to the embodiment, the toner conveying device 43, the second transmission mechanism 64, and the rail member 41R are configured as a unit obtained by integrating them with each other. Thereby, the unit can be detached from the frames 40F, 40R in one step and thus maintenance of the toner conveying device 43 and the second transmission mechanism 64 can be easily and speedily carried out.

Incidentally, although, in the embodiment, the driving motor 62 was fixed to the frame 40R, this driving motor may be fixed to the rail member 41R without being limitative thereto. In this case, it is preferable that the first transmission mechanism 63 be also integrated with the rail member 41R in addition to the toner conveying device 43 and the second transmission mechanism 64. Furthermore, although, in the embodiment, the intermediate transferring device 42 and the toner conveying device 43 were provided at the rear rail member 41R, these devices may be provided at the front rail member 41F without being limitative thereto.

Still further, the case in which the present disclosure is applied to the color printer 1 as one example has been described in the present embodiment, the present disclosure is not limited to such case, and the present disclosure is applicable also to a multi-functional peripheral, facsimile, a monochrome printer, and the like.

While the preferable embodiment and its modified example of the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

What is claimed is:

1. An image forming apparatus comprising:

a rail member mounted to a frame; and an intermediate transferring device attachably/detachably mounted to the rail member, wherein the intermediate transferring device is configured to include:

a toner carrier driven to be rotated by a driving source, and configured to carry a toner image;

a cleaning member driven to be rotated by the driving source, and configured to remove a toner which remains on the toner image carrier, a first transmission mechanism configured to transmit a driving force of the driving source to the toner image carrier; and a second transmission mechanism configured to transmit the driving force of the driving source to the cleaning member, and wherein the first transmission mechanism and the second transmission mechanism are arranged between the frame and the rail member.

2. The image forming apparatus according to claim 1, wherein the toner image carrier is configured as an intermediate transferring belt overhung between a driving roller and a driven roller, the driving roller is driven to be rotated by the driving source via the first transmission mechanism, the cleaning member is configured as a cleaning roller disposed on a side of the driven roller, and the second transmission mechanism has:

a driving pulley driven to be rotated by the driving source;

a driven pulley rotatably provided to move together with the cleaning roller; and a timing belt overhung between the driving pulley and the driven pulley.

3. The image forming apparatus according to claim 2, wherein the frame is disposed in a pair to be spaced from each other, the rail member is mounted in a pair inside of the pair of frames that are disposed to be spaced from each other, the driving roller, the driven roller, and the intermediate transferring belt are provided between a pair of belt frames, and constitute a belt traveling device, and the belt traveling device and the cleaning member are slidably mounted between the pair of rail members.

4. The image forming apparatus according to claim 1, further comprising a toner conveying device configured to convey the toner housed in a toner container toward a development device, wherein the toner conveying device is arranged between the frame and the rail member.

5. The image forming apparatus according to claim 4, wherein the toner conveying device and the second transmission mechanism are coupled to, and are integrated with, the rail member.

6. The image forming apparatus according to claim 4, wherein the toner conveying device has a conveying screw configured to convey, toward a conveying and discharging port, the toner introduced from a conveying and replenishment port into an intermediate conveying path, and the second transmission mechanism transmits a driving force of the driving source to the conveying screw.

* * * * *